United States Patent [19]

Casull

[11] 4,385,463

[45] May 31, 1983

[54] FLOATING FIRING PIN FOR SMALL REVOLVER

[76] Inventor: Richard J. Casull, P.O. Box 276, Freedom, Wyo. 83120

[21] Appl. No.: 263,417

[22] Filed: May 14, 1981

[51] Int. Cl.[3] ..... F41C 1/00

[52] U.S. Cl. ..... 42/65; 42/59; 42/69 R

[58] Field of Search ..... 42/65, 59, 69 R, 66, 42/67

[56] References Cited

U.S. PATENT DOCUMENTS

| | | | |
|---|---|---|---|
| 552,699 | 1/1896 | Richardson | 42/59 |
| 1,487,722 | 3/1924 | Coenders | 42/59 |
| 2,863,249 | 12/1958 | Koucky et al. | 42/67 |
| 2,874,501 | 2/1959 | Koucky et al. | 42/59 |
| 3,157,958 | 11/1964 | Lewis | 42/66 |
| 3,810,326 | 5/1974 | Hillberg et al. | 42/65 |

*Primary Examiner*—Charles T. Jordan

*Attorney, Agent, or Firm*—Terry M. Crellin; B. Deon Criddle

[57] ABSTRACT

A small, single action revolver having a spring-biased, floating firing pin which is retained within a bore in the frame of the revolver by a lip on the inside surface of a side cover plate which, in turn, is attached to the frame and encloses the hammer and trigger mechanism within a recess in the frame.

2 Claims, 3 Drawing Figures

FLOATING FIRING PIN FOR SMALL REVOLVER

BACKGROUND OF THE INVENTION

1. Field

The invention relats to small, single action revolvers similar in size to small derringers. More particularly, the invention relates to a floating firing pin mechanism to be used in such small revolvers.

2. Start of the Art

Revolvers of various sizes and shapes are well known in the art. In those very small revolvers similar in size to a small derringer, the hammer has a leading edge or projection thereon which actually strikes the end of the cartridge during firing of the revolver. Such firing systems are shown in U.S. Pat. Nos. 4,024,663; 4,228,608; 3,407,526; and 3,824,728. In larger handguns a firing pin arrangement has been proposed in which the firing pin and a rebound spring are positioned within a cylindrical insert which, in turn, is held in a cylindrical bore in the frame by a cross pin. Such firing pin arrangements are shown in U.S. Pat. Nos. 2,733,529; 3,176,423; 3,654,720; and 3,696,543. Because of the small size of the smaller, derringer-like revolvers, it is impracticable to use the firing pin arrangements as shown in the latter patents.

3. Objective

The principal objective of the present invention is to provide a practicable firing pin of the spring-biased floating type for use in very small revolvers. Another objective is to provide a simplified firing pin mechanism that can be used with very small sized revolvers and is of inherently durable construction.

SUMMARY OF THE INVENTION

The above objectives are achieved in accordance with the present invention by providing a firing pin which is received in a cylindrical well bored inwardly in the frame of the revolver from the recess in the frame in which the hammer is mounted towards the cylinder of the revolver. A bore having a smaller diameter than the well is bored concentrically inwardly from the inner end of the well to the opening in the frame in which the cylinder is mounted.

A firing pin comprises a base portion having a cylindrical shape adapted to be received in the well with the length of the base portion of the firing pin being less than the depth of the well. An elongate pin portion extends axially from the inner end of the base portion of the firing pin with the pin portion extending between the well and the opening in the frame in which the cylinder is mounted.

Spring means is positioned in the well between the annular shoulder at the inner end of the well and the inner end of the base portion of the firing pin so that the firing in is biased by the spring in a direction toward the recess in the frame and the hammer which is mounted in the recess. Means are provided for retaining the firing pin within the well and limiting the rearward movement of the firing pin towards the recess and the hammer mounted within the recess. The means for retaining the firing pin in the well and limiting the rearward movement of the firing pin comprises a lip on the inside surface of the side cover plate. The lip is adapted to engage a portion of the rim or side edge of the rear end of the base portion of the firing pin, with the rear end of the base portion of the firing pin being defined as the end of the base portion which faces the recess and the hammer which is mounted in the recess.

The lip on the inside surface of the side cover plate is positioned so that when the hammer is moved to its cocked position, the firing pin moves rearwardly into contact with the lip, with a portion of the rear end of the base portion of the firing pin extending into the recess. When the trigger of the revolver is pulled and the hammer moves forward, the hammer strikes the rear end of the firing pin and drives the firing pin forward against the biasing force of the spring. The elongate pin portion of the firing pin, which extends from the inner end of the base portion, is driven forward through the bore in the frame in which it is received, and the leading end thereof projects from the bore into the opening in which the cylinder is mounted to strike the end of a cartridge contained within the cylinder.

Additional objects and features of the invention will become apparent from the following detailed description taken together with the accompanying drawings.

THE DRAWINGS

A particular embodiment of the present invention representing the best mode presently contemplated of carrying out the invention is illustrated in the accompanying drawings in which.

DETAILED DESCRIPTION OF THE ILLUSTRATED EMBODIMENT

Figure 2:
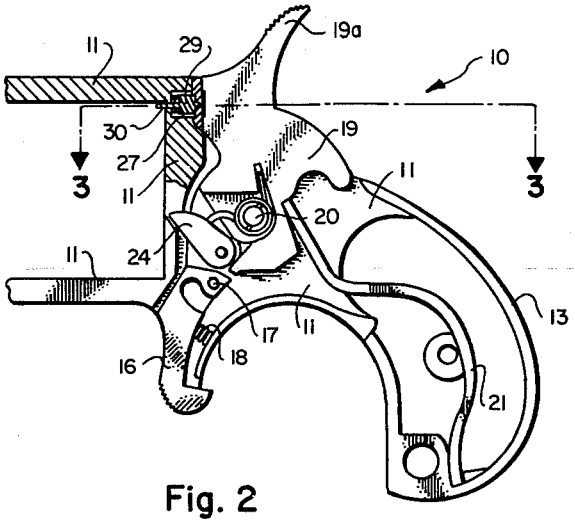
FIG. 2 is a partial vertical section though the portion of the revolver of FIG. 1 containing the firing mechanism.
Figure 1:
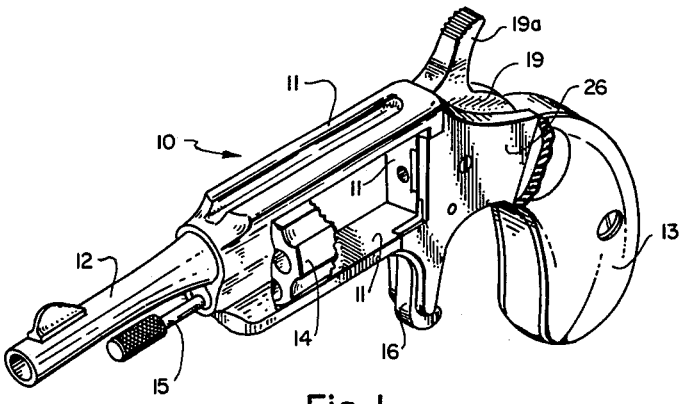
FIG. 1 is a pictorial view of a revolver in accordance with this invention with portions of the cylinder and hand grip being broken away to show the side cover plate on the frame of the revolver.

A preferred embodiment of a revolver in accordance with this invention is shown in the drawings, wherein the revolver, shown generally by the numeral 10 has the usual frame 11 with a barrel 12 and a handle 13. The revolver is further of the type comprising a cylinder 14 which is mounted in frame 11 and is held in place by a removable cylinder pin 15 that also serves as an axis about which the cylinder 14 revolves. A trigger 16 is pivotally mounted by a pin 17 to the frame 11, and a spring 18, which is partially recessed in the frame, engages the trigger 16 to bias it to a forward position. A hammer 19 is pivotally mounted to the frame 11 by a pivot pin 20. The hammer includes a thumb projection **19*a* to be used in pivoting the hammer 19 to a cocked position and a flat striker surface for striking the firing pin as to be explained more fully hereinafter. A spring 21 is engaged in a notch on the hammer, with the other end of the spring 21 being anchored to the bottom portion of the handle 13. The spring 21 biases the hammer to pivot clockwise about the pivot pin 20. The trigger 16 is activated when the hammer 19 is pivoted to its cocked position and holds the hammer in its cocked position. When the trigger 16 is pulled, the hammer 19 rotates forward to fire the revolver. The cylinder 14 has a plurality of cartridge-receiving chambers, and the cylinder 14 is partially rotated each time the hammer 19 is cocked, to bring the next or subsequent chamber in the cylinder 14 into its firing position in alignment with the barrel. The hammer 19, trigger 16, and the cylinder rotating means, such as the hand or pawl 24 shown in FIG. 2, are positioned in a recess 22 (best shown in FIG. 3) formed within the frame 11 of the revolver, and a removable cover plate 26 (FIGS. 1 and 3**) is provided on one side of the revolver for access to the parts positioned within the recess.

The mechanism heretofore described, including the revolver frame, handle, barrel, cylinder, means for operating the cylinder in response to cocking the hammer, the hammer generally, the hammer operating spring and the trigger assembly are all well known in the revolver art and do not, per se, constitute part of the present invention. For a more complete description of a revolver mechanism as described generally in the preceeding paragraph, one is referred to U.S. Pat. No. 4,228,608 which was issued to me on Oct. 21, 1980, the entire contents of which are incorporated herein by reference.

In accordance with the present invention, an improved firing pin mechanism is provided for use in very small revolvers similar in size to a derringer. As illustrated, a well 27 is formed in the portion of the frame separating the recess 22 from the open space in the frame in which the cylinder 14 is mounted. The well 27 extends inwardly from the recess 22 towards the open space in which the cylinder 14 is mounted. A bore 28 (FIG. 3) which has a smaller diameter than the well 27 is bored concentrically inwardly from the inner end of the well 27 through the frame to the open space in the frame in which the cylinder 14 is mounted. There is, thus, an annular shoulder formed at the inner end of the well around the open end of the bore 28. The well 27 and bore 28 are positioned near the upper portion of the recess 22 so that the bore 28 will align with a cartridge which is positioned in the cylinder 14 in alignment with the barrel 12.

A firing pin mechanism is received in the well 27 and bore 28. The firing pin mechanism comprises a base portion 29 of cylindrical shape which is adapted to be received in the well 27. The diameter of the base portion 29 is slightly less than the diameter of the well 27 so that the base portion 29 is free to slide back and forth in the well 27. The length of the base portion 29 is less than the depth of the well 27 so that space is provided in the well 27 for reciprocating movement of the base portion 29 in a direction along the cylindrical axis of the well 27. An elongate pin portion 30 of the firing pin mechanism extends axially from the inner end of the base portion 29. The pin portion 30 extends into and through the bore 28, whereby the pin portion 30 moves in reciprocal motion in the bore 28 corresponding to the motion of the base portion 30 in the well 27.

Spring means, such as the coil spring 31 (FIG. 3) is positioned in the well 27 between the shoulder at the inner end of the well 27 and the base portion 29 of the firing pin mechanism so as to bias the base portion 29 and pin portion 30 of the firing pin toward the recess 22 in the frame 11. As can be seen, the length of the base portion 29 of the firing pin must be sufficiently shorter than the depth of the well 27 to permit the positioning of the coil spring 31 at the bottom of the well 27.

As can be seen, with the well 27 opening into the recess 22 as it does, the firing pin mechanism comprising the base portion 29, pin portion 30 and coil spring 31 are conveniently and easily inserted into the well 27 and bore 28 through the open end of the well 27. To retain the firing pin mechanism within the well 27 and bore 28 as well as to limit the rearward motion of the base portion 29 and pin portion 30 of the firing pin, a lip 32 (FIG. 3) is provided on the inside surface of the side cover plate 26. The lip is adapted to engage a portion of the side edge of the rear end of the base portion 29 of the firing pin which faces the hammer 19 mounted in the recess 22. The lip 32 is positioned so as to limit the rearward movement of the firing pin due to the biasing force of the spring 32.

Figure 3:
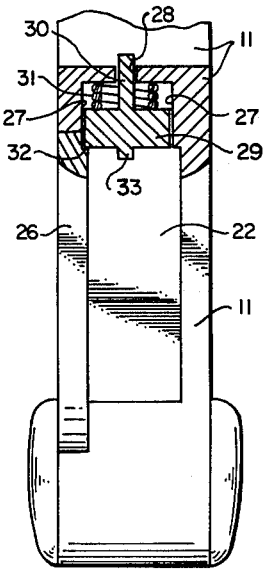
FIG. 3 is cross sectional view taken along line 3—3 of FIG. 2, with the hammer mechanism being deleted for clarity.

The degree of rearward movement is such that when the hammer 19 is moved, i.e., pivoted, to its cocked position and the striker surface on the hammer 19 moves away from the well 27, the firing pin moves rearwardly by a limited short distance so that only a limited portion of the rear end of the base portion 29 extends into the recess 22. Typically, the rear end of the base portion 29 will project or extend into the recess 22 by no more than 1 to 2 millimeters and preferably by about 1 millimeter. As is illustrated in FIG. 3, the combined length of the base portion 29 and pin portion 30 of the firing pin assembly is such that when the firing pin is in its rearward position, i.e., with the hammer 19 cocked, the leading end of the pin portion 30 is just beginning to emerge from the bore 28 into the open space in which the cylinder 14 is mounted.

In a preferred embodiment of the invention as illustrated, the rear end of the base portion 29 of the firing pin has a striker nub 33 extending axially therefrom, and it is only the striker nub 33 which extends or projects into the recess 22 when the hammer 19 is cocked. In such an embodiment, the lip 32 is positioned so as to engage the rim of the base portion 29 of the firing pin at the surface of the well 27. Thus, only the nub 33 extends or projects into the recess 22.

In the preferred, illustrated embodiment, the well 27 and firing pin mechanism are offset slightly from the longitudinal center plane of the revolver towards the side plate 26. The side of the frame adjacent to the cover plate 26 is notched away near the surface of the well 27, and a portion of the side cover plate 26 is shaped to fit snug within the notched out section of the frame 11. The portion of the side cover plate 26 which fits within the notched out section of the frame 11 must have a shallow arcuate recess in its inner surface to form a portion of the cylindrical sidewall of the well 27. The lip 32 is then formed by the end of that shallow recess in the inner surface of the cover plate 26 as shown in FIG. 3.

When the trigger 16 is pulled, and the hammer 19 pivots forward to its fired position, the flat striker surface of the hammer 19 strikes the portion of the firing pin which extends into the recess. In the illustrated embodiment, the hammer 19 strikes the nub 33 on the base portion 29 of the firing pin and drives the firing pin forward against te biasing force of the spring 31. The leading end of the pin portion 28 of the firing pin is, in turn, driven forward so as to emerge from the bore 28 in the frame 11 to strike the end of a cartridge in the cylinder 14. Upon recocking the hammer 19, the firing pin moves backward to its ready-to-fire position by the biasing force of spring 31, and the revolver is again ready to be fired.

Although a preferred embodiment of the invention has been illustrated and described, it is to be understood that the present disclosure is made by way of example and that variations are possible without departing from the subject matter coming within the scope of the following claims, which subject matter I regard as my invention.

I claim:

1. In a small, single action revolver of the type comprising a frame including a handle and a cylinder mounting portion, a cylinder, a barrel, a hammer, a trigger and a side cover plate which is attached to the frame and encloses the hammer and trigger in a recess in the frame of the revolver, a firing pin mechanism comprising:

a cylindrical well in the frame extending inwardly from said recess in which the hammer is mounted towards the cylinder;

a bore having a smaller diameter than said well and bored concentrically inwardly from the inner end of said well through the frame to the open space in the frame which receives the cylinder, whereby an annular shoulder is formed at the inner end of said well around the open end of said bore;

a firing pin comprising a base portion having a cylindrical shape adapted to be received in said well, with an elongate pin portion extending axially from the inner end of said base portion, said pin portion adapted to extend into and through said bore, whereby the firing pin can move in reciprocal movement such that the pin portion thereof moves longitudinally back and forth within said bore;

spring means positioned in said well between the shoulder at the inner end of said well and said base portion of said firing pin so as to bias the firing pin toward the recess in said frame; and a lip on the inside surface of the side cover plate, said lip being adapted to engage a portion of the side edge of the rear end of the base portion of the firing pin which faces the hammer mounted in said recess, said lip limiting the rearward movement of the firing pin towards said recess as a result of the biasing force of said spring means, so that when the hammer moves to its cocked position, a portion of the rear end of said base portion of said firing pin extends into said recess, and when the hammer moves forward in the firing of the revolver, the hammer strikes the rear end of the firing pin and drives the firing pin forward against the biasing force of said spring means.

2. A small single action revolver in accordance with claim 1, wherein the rear end of the base portion of the firing pin has a striker nub extending axially therefrom; and said lip limits the rearward movement of the firing pin in a direction towards said recess so that only the striker nub on the rear end of the base portion of the firing pin extends into said recess when the hammer is moved to its cocked position.

* * * * *